United States Patent [19]

Ward et al.

[11] Patent Number: 4,889,373

[45] Date of Patent: Dec. 26, 1989

[54] DOOR HANDLE UNIT

[75] Inventors: Marcus J. S. Ward, Billericay; Peter J. Seymour, Hullbridge, both of United Kingdom

[73] Assignee: Ford Motor Company, Dearborn, Mich.

[21] Appl. No.: 120,058

[22] Filed: Nov. 13, 1987

[30] Foreign Application Priority Data

Nov. 14, 1986 [GB] United Kingdom ..... 8627245
Dec. 23, 1986 [GB] United Kingdom ..... 8630707

[51] Int. Cl.[4] ..... E05B 3/00

[52] U.S. Cl. ..... 292/336.3; 292/DIG. 31; 292/DIG. 62

[58] Field of Search ..... 292/336.3, DIG. 31, 292/DIG. 23, DIG. 62, DIG. 25, 113, 254, DIG. 24, 309

[56] References Cited

U.S. PATENT DOCUMENTS 3,111,338 11/1963 Kimble ..... 292/336.3
3,153,552 10/1964 Sandor ..... 292/DIG. 31 X
3,606,428 9/1971 Erck et al. ..... 292/336.3
4,038,718 8/1977 Reilhac et al. ..... 292/DIG. 31 X
4,268,077 5/1981 Bohleen et al. ..... 292/336.3
4,693,503 9/1987 Bisbing ..... 292/DIG. 31 X
4,778,207 10/1988 Gergoe ..... 292/336.3

FOREIGN PATENT DOCUMENTS 70478 12/1958 France ..... 292/336.3
25151 10/1919 Netherlands ..... 292/209
1249923 10/1971 United Kingdom .
2028912 3/1980 United Kingdom .
2144794 3/1985 United Kingdom .
2159565 12/1985 United Kingdom .
2161854 1/1986 United Kingdom .

*Primary Examiner*—Gary L. Smith
*Assistant Examiner*—Douglas E. Ringel
*Attorney, Agent, or Firm*—Daniel M. Stock; Clifford L. Sadler

[57] ABSTRACT

A handle unit for a vehicle door lock system has a lever door handle mounted on a pivot in a housing. The lever can be locked in the position which corresponds to a "door locked" condition. A release button allows the lever to be locked or released so that the lever can be operated. The lever is locked by a detent which captures the lever and can be released by pushing the detent away from the lever.

10 Claims, 3 Drawing Sheets

FIG. 1.
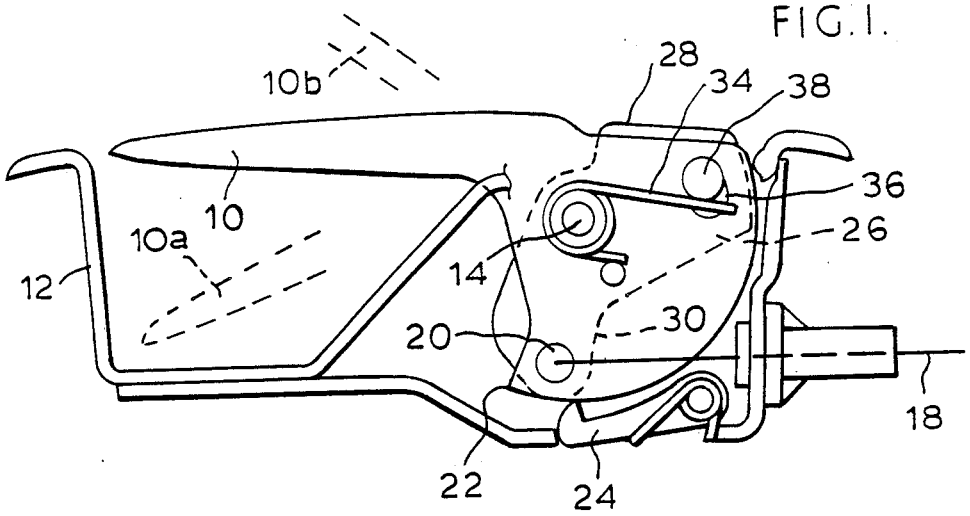
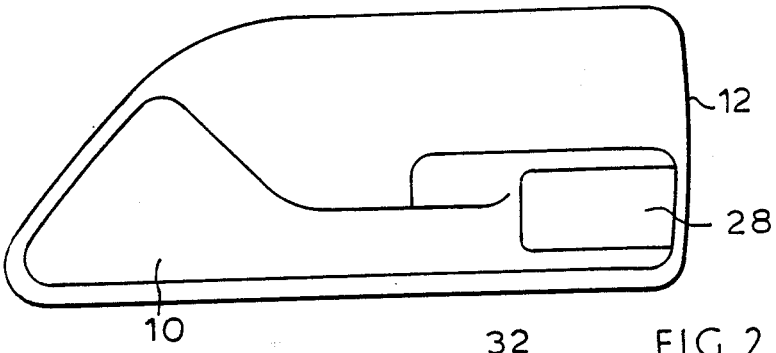
FIG. 2.
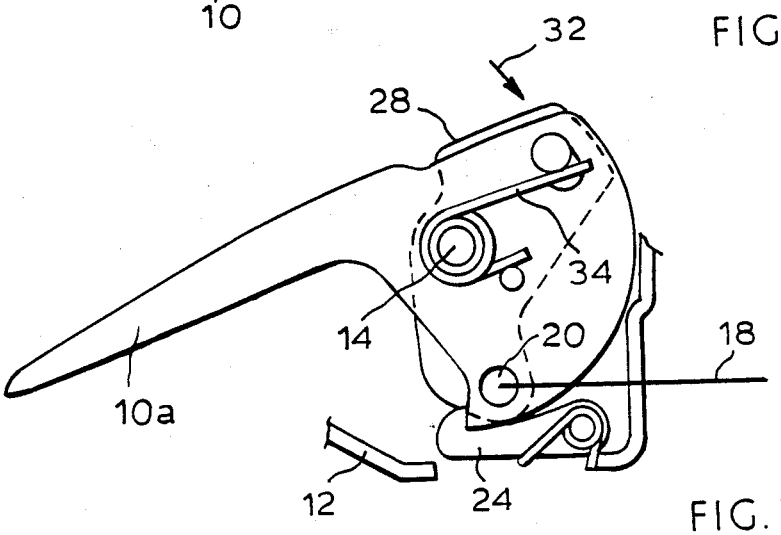
FIG. 3.

DOOR HANDLE UNIT

BACKGROUND OF THE INVENTION

This invention relates to a door handle unit for a vehicle door lock system in which the interior door handle is connected to the latch mechanism by means of a single, push-pull cable. A door lock system of this type is described in our British Patent specification No. 2 161 854 A.

In the system described in that specification, the internal handle which is conveniently of a lever type has three positions, namely locked, unlocked but latched and unlatched. To change the state of the lock system between these three settings only requires movement of the door handle.

In some countries, it is a requirement that the door handle itself should become inoperable when the vehicle door is locked. It is an object of the present invention to provide this feature in a door lock system of the type discussed above.

SUMMARY OF THE INVENTION

According to the invention there is provided a door handle unit for a vehicle door lock system, the unit having settings for locked and unlocked lock conditions and comprising a door handle mounted on a pivot in a housing, a release member mounted in proximity to the handle, and a detent arranged to capture the handle when the locked lock condition is set and to prevent the handle being moved to set the unlocked lock condition, wherein the release member can be operated to move the detent and to release the handle.

In one form of unit according to the invention, the operating cable is connected directly to the handle which is itself movable between locked and unlocked conditions, as well as between unlocked and unlatched positions.

The release member, which is mounted in proximity to the handle, may be mounted alongside the handle or, preferably, between two side Portions of the handle.

Preferably the handle is spring-loaded for movement on its pivot so that, when the detent is moved, the handle is spring-biased to its unlocked position.

The release member may be a cam mounted on the same pivot in the housing as the door handle itself, and there can be a lost motion connection between the release member and the handle.

The release member preferably includes a button which can be pressed to operate the member.

In this form of unit, the detent is preferably spring-loaded, and may be a pawl or a stiff wire loop. The release member may be located in a slot-like recess in the handle itself.

However in another form of unit according to the invention, the operating cable is connected to the release member and the release member is connected to the handle through a lost motion connection. The release member is then movable between the locked and unlocked conditions. Once the unlocked condition is reached, the handle is free and can be moved to the unlatched position, taking the release member with it and thereby pulling the cable.

The lost motion connection preferably operates in such a way that movement of the release member between the locked and unlocked conditions takes place without corresponding movement of the handle. Once the release member reaches the unlocked position however, all the lost motion has been taken up and the handle and release member move together between the unlocked and unlatched positions.

The detent is preferably a pivotally mounted pawl which is pivoted in one direction when the release member moves one way, and in an opposite direction when the release member moves the other way. The connection between the release member and the pawl may be effected by a pin on the release member and lugs on the pawl on opposite sides of the pin so that the pin trips the pawl in the appropriate direction.

BRIEF DESCRIPTION OF THE DRAWINGS

The invention will now be further described with reference to the accompanying drawings, in which:

FIG. 1 is a side view, in section, through a door handle unit according to the invention;

FIG. 2 is a plan view of the unit shown in FIG. 1;

FIGS. 3 and 4 show details of the unit shown in FIGS. 1 and 2, in two different stages of operation;

DESCRIPTION OF THE PREFERRED EMBODIMENTS

Figure 4:
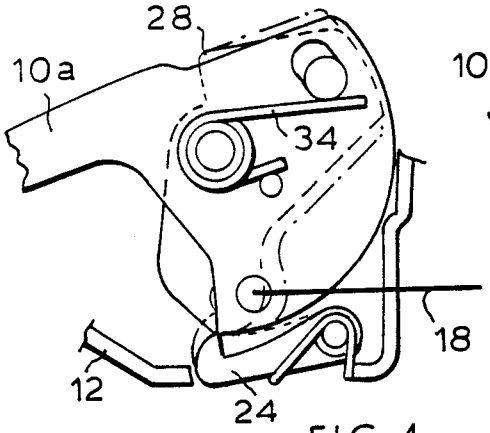
Figure 7:
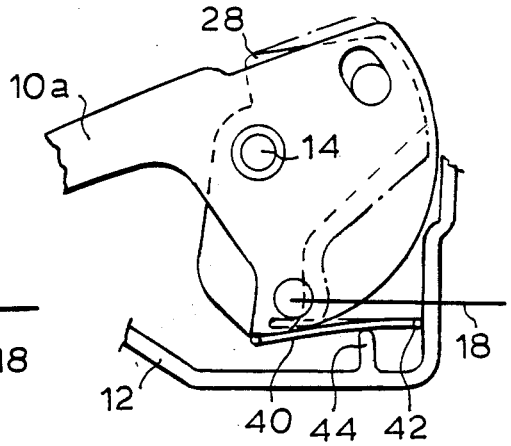
FIGS. 6 and 7 are detailed views of the second embodiment corresponding to FIGS. 3 and 4.

FIG. 1 shows a handle 10 mounted in a housing 12. The housing 12 is carried in known fashion in the door of an automobile preferably in an inner trim panel. The handle is journalled on a pivot axis 14. Turning of the handle about the axis 14 causes an operating cable 18 to be pushed or pulled. The cable 18 is the inner wire of a Bowden cable, and details of how this is used to operate a vehicle door latch will be apparent from our UK patent specification No. 2 161 854. For the purposes of the present description, it is only necessary to know that the handle 10 has three possible positions. One position of the handle 10 (the unlocked but latched position) is shown in bold lines in FIG. 1. A second position (the locked position) is shown by dotted lines **10*a*, and a third position (the unlatched or released position) is shown by dotted lines 10*b* in FIG. 1. Movement of the handle between these three positions causes the cable 18 to be pushed or pulled. The end of the cable 18 is connected to the handle at an attachment point 20. The handle 10 is in the form of a bell-crank lever and raising of the handle to the position 10*b* pulls on the cable 18 whereas depression of the handle to the position 10*a*** pushes on the cable.

When a central automatic lock control system is used, the handle can be moved between the first and second positions by operation of the central automatic lock control system which acts on a latch mechanism connected to the other end of the Bowden cable 18, in the manner described in our above-mentioned UK Patent Specification.

The lower (as viewed in FIG. 1) limb of the handle 10 has a sharp corner 22 which is captured by a pawl 24 when the handle is depressed to the position **10*a*. This can be seen in FIG. 3. In this position the handle itself is locked (in addition to the door lock being in a locked condition), and the handle 10 cannot be lifted. In order to be able to lift the handle 10 it is necessary to first release the pawl 24, and this is done with the assistance of a release member 26. The release member 26 is carried in a slot-like recess between side portions of the handle 10, as may best be seen in FIG. 2 and has an accessible surface 28 which acts as a release button, and a cam profile 30. The release member 26 is pivotally mounted on the same pivot 14** as the handle.

In the locked position of the handle 10 (as seen in FIG. 3) the corner 22 is retained by the pawl 24. To release this engagement, it is necessary to press down on the release button 28 in the direction indicated by the arrow 32 in FIG. 3. This causes the release member to rotate to the position shown in FIG. 4, and this causes the pawl to be depressed as shown to a position where the handle 10 is released. When this happens, a spring 34 which acts between the handle 10 and the release member 26, causes the handle to be rotated into its central, unlocked position.

Movement of the release member 26 is limited by a lost-motion connection between the member 26 and the handle 10. This connection comprises a slot 36 in the handle and a peg 38 on the release member. The degree of lost motion between the release member 26 and the handle 10 is sufficient to allow the release member 26 to depress the pawl. Further pressure on the release button 28 is therefore directly transferred to the handle and assists the action of the spring 34 in bringing the handle 10 to its central position. The handle 10 can therefore be brought into its unlocked position simply by pressing on the button 28.

Figure 5:
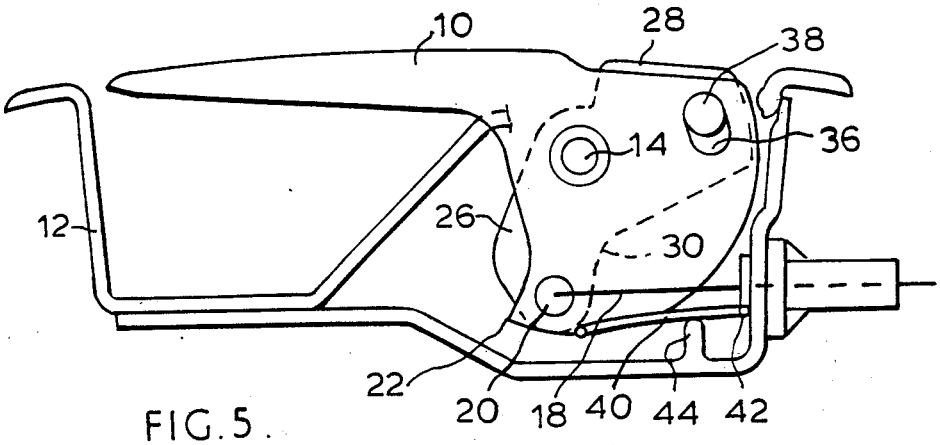
FIG. 5 is a side view of a second embodiment of the invention.
Figure 6:
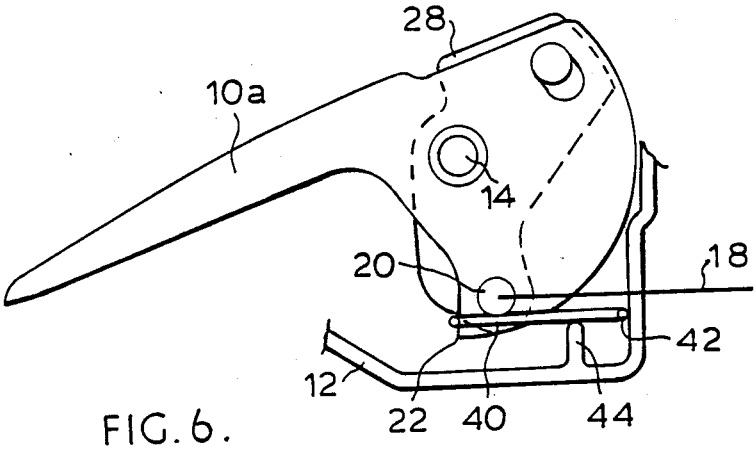

FIG. 5 shows an alternative embodiment where the pawl 24 is replaced by a U-shaped spring 40. The closed base of the U shape forms a detent which captures the corner 22 of the handle. The other end of the spring is attached to the housing 12 at 42, and the necessary restoring force on the spring 40 which enables it to recapture the corner 22 of the handle is provided by an upstanding wall 44 in the base of the housing 12.

The embodiment shown in FIG. 5 also omits the spring 34, and the restoring force which brings the handle up to its central position as shown in FIG. 5 is provided by continued operation of the button 28, after the U-shaped spring 40 has been released from the handle 10.

Figure 8:
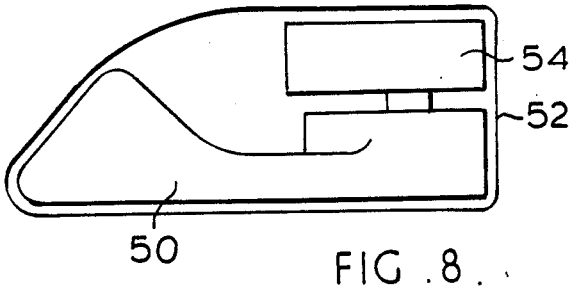
FIG. 8 is a plan view of a third embodiment of the invention.
Figure 9:
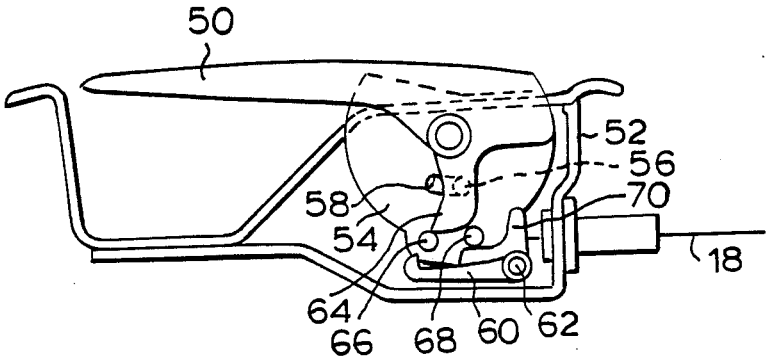
FIG. 9 is a side view of the unit shown in FIG. 8.
Figure 10:
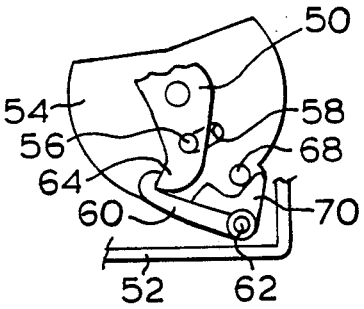
FIG. 10 is a detail of the mechanism in an alternative position.
Figure 11:
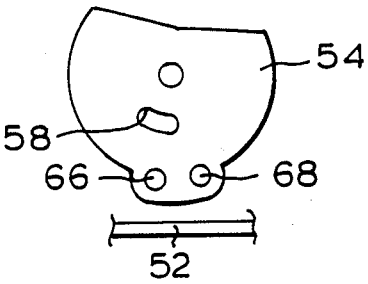
FIG. 11 shows the release member alone.

In FIGS. 8, 9 and 10, a handle 50 is shown in a housing 52 with a release member 54 mounted in the housing coaxially with the handle. In this embodiment, the handle 50 does not move inward of the flush position shown in these Figures; i.e. it will not be capable of being depressed to the position 10*a* as is possible with the handles shown in the previous Figures.

Both the handle 50 and the release member 54 are mounted on the same axis and are rotatable on the axis. A laterally projecting pin 56 on the handle 50 projects into an annularly extending slot 58 on the release member 54 to form a lost motion connection. A pawl 60 is mounted on an axis 62 in the bottom of the housing 52 and cooperates with a Projecting lug 64 on the handle 50. The operating cable 18 is connected to the release member 54 at 66.

FIG. 9 shows the handle 10 released by the pawl 60. In this position, the handle 50 can be turned clockwise. The first part of this movement is free and has no effect on the cable 18, until the pin 56 reaches the end of the slot 58. Once this position is reached, further turning of the handle entrains the release member 54 which then pulls on the cable 18 and operates the latch mechanism to open the door. When the handle 50 is released, it will be returned to its flush, rest position by a return spring (not shown) acting on the cable 18.

To lock the door, the release member 54 is rocked about its axis by pressing down on the left-hand side of the member 54 (as viewed in FIG. 8). This movement takes place without any corresponding movement 50 of the handle, due to the lost motion connection.

The release member 54, however, also carries a laterally projecting pin 68 which acts on one or other end of a rocker formation 70 integrally formed with the pawl 60. This movement of the release member 54 brings the pin 68 against the part of the rocker formation 70 which is shown in a vertical position in FIG. 9. Full movement of the release member 54 causes the pawl 60 to rock about its axis 62 so that it takes up the locked position shown in FIG. 10, where the pawl 60 captures the lug 64 on the handle 50 and thereby prevents the handle 50 being turned clockwise to the unlatching position.

From this position, the unlocked condition of the handle 50 is reached by pressing down the right-hand end of the release member 54 (as seen in FIG. 10), so that the pawl 60 is swung in the opposite direction to release the handle 50.

The handle unit described thus provides a compact and easy to operate assembly which meets the requirements of countries, such as the United States of America, where a locking mechanism separate from the handle itself is required, without compromising the benefits of having a single, flexible cable connecting the handle to the door latch.

We claim:

1. A door handle unit for a vehicle door lock system, the unit comprising a housing adapted to be flush-mounted in a door trim panel, a handle assembly pivotally mounted in the housing and means for connecting one end of a door lock operating cable to the handle assembly, the handle assembly comprising a handle and a release member both mounted on a common pivot axis in the housing and a detent member arranged to capture the handle when a locked condition of the handle is set and to prevent the handle being moved to an unlocked condition, and means for operating the release member to move the detent and to release the handle, and wherein the handle is spring-loaded for movement on the pivot axis so that, when the detent is moved, the handle is spring-biased to its unlocked position.

2. A door handle unit as defined in claim 1, wherein the operating cable is connected directly to the handle, and the handle is movable between locked and unlocked conditions, and further movable between unlocked and unlatched positions.

3. A door handle unit as defined in claim 1 or claim 2, wherein the release member is mounted between two side portions of the handle.

4. A door handle unit as defined in claim 1, wherein the release member is a cam mounted on the same pivot in the housing as the door handle itself.

5. A door handle unit as defined in claim 1, wherein there is a lost motion connection between the release member and the handle.

6. A door handle unit as defined in claim 1, wherein the release member includes a button which can be pressed to operate the member.

7. A door handle unit as defined in claim 1, wherein the detent is spring-loaded to a position engaging a portion of the handle.

8. A door handle unit as defined in claim 7, wherein the spring-loaded detent is a pawl.

9. A door handle unit as defined in claim 7, wherein the spring-loaded detent is a stiff wire loop.

10. A door handle unit as defined in claim 1, wherein the release member is located in a slot-like recess in the handle itself.

* * * * *